US008107835B2

(12) United States Patent
Mizude et al.

(10) Patent No.: US 8,107,835 B2
(45) Date of Patent: Jan. 31, 2012

(54) ABNORMALITY DETECTING METHOD AND IMAGE PROCESSING METHOD FOR IMAGE PROCESSOR

(75) Inventors: Kazuhiro Mizude, Kizugawa (JP); Tsutomu Yoshimoto, Yamato-Takada (JP); Hiromasa Shibano, Yamato-Koriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 950 days.

(21) Appl. No.: 11/882,910

(22) Filed: Aug. 7, 2007

(65) Prior Publication Data

US 2008/0038005 A1 Feb. 14, 2008

(30) Foreign Application Priority Data

Aug. 11, 2006 (JP) ..... 2006-219294

(51) Int. Cl.
*G03G 15/00* (2006.01)

(52) U.S. Cl. ..... 399/49; 399/15

(58) Field of Classification Search ..... 399/49, 399/15, 301, 31, 72, 250
See application file for complete search history.

(56) References Cited

U.S. PATENT DOCUMENTS 5,995,802 A * 11/1999 Mori et al. ..... 399/394
6,195,170 B1 * 2/2001 Mizutani et al. ..... 358/1.14
7,035,558 B2 * 4/2006 Rodriguez ..... 399/49
2005/0047834 A1 3/2005 Tomita et al.

FOREIGN PATENT DOCUMENTS

| | | | |
|---|---|---|---|
| JP | 4-131875 | A | 5/1992 |
| JP | 8-305223 | A | 11/1996 |
| JP | 10-333391 | A | 12/1998 |
| JP | 2002-365877 | A | 12/2002 |
| JP | 2003-149952 | A | 5/2003 |
| JP | 2005-265951 | A | 9/2005 |

* cited by examiner

*Primary Examiner* — Mark R Gaworecki
(74) *Attorney, Agent, or Firm* — Birch, Stewart, Kolasch & Birch, LLP

(57) ABSTRACT

An abnormality detecting method and an image processing method for an image processor is provided. The image processor can easily detect an abnormal rotation of a photosensitive drum without having a special detecting means but using an existing sensor, and keeps image data until a normal toner image is transferred and fine printing is carried out. The image processor forms a toner image corresponding to image data on a plurality of photosensitive drums, and detects the position of the toner image at a given part on a transfer object, to which given part the toner image formed on the photosensitive drum is transferred, to detect a rotation failure of the photosensitive drum. When a rotation failure is detected, the image processor keeps input image data without deleting even after the end of image formation.

10 Claims, 4 Drawing Sheets

ABNORMALITY DETECTING METHOD AND IMAGE PROCESSING METHOD FOR IMAGE PROCESSOR

CROSS-NOTING PARAGRAPH

This Non-provisional application claims priority under 35 U.S.C. §119 (a) on Patent Application No. 2006-219294 filed in JAPAN on Aug. 11, 2006, the entire contents of which are hereby incorporated herein by reference.

FIELD OF THE INVENTION

The present invention relates to an abnormality detecting method and an image processing method for an image processor that forms a toner image corresponding to image data on a photosensitive drum and transfers the toner image to a transfer object.

BACKGROUND OF THE INVENTION

A copier, fax machine, printer, etc., are now essential equipment for paperwork. These days, an image forming apparatus working as a complex machine having all the functions provided by those copier, fax machine, printer, etc., has been widely noticed. This image forming apparatus has a function of recording an image of characters and figures on a sheet of recording paper, and is capable of recording a monochrome image and a color image. In order to deal with increasing paperwork efficiently, it is required to improve the processing speed of an image recording apparatus. It is especially required to improve the processing speed for color printing and therefor, the image formation process using a tandem method has been widely employed.

An image forming apparatus using the tandem method simultaneously forms toner images of four colors of yellow (Y), magenta (M), cyan (C), and black (K) on dedicated photosensitive drums, and superimposes the toner images on an intermediate transfer object (e.g., endless belt) or directly on a recording paper. By employing this method, it can be expected to achieve printing speed four times faster than those of other methods.

The image forming apparatus using the tandem method forms an image using electrostatic power. Because of this, a characteristic changes due to a service status of each processing unit or environment and that readily leads to a change in the concentration of a formed image. To prevent such trouble, for example, process control in image formation is carried out by forming a patch image (square of several mm in length and breadth) for toner concentration detection when the image forming apparatus is started or after it is operated for a given time, by detecting the toner concentration of the patch image with an optical sensor, and by adjusting control conditions for components of an image forming unit on the basis of the detected toner concentration (e.g., see Japanese Laid-Open Patent Publication No. 2003-149952).

When toner images colored in Y, M, C, and K are formed on the photosensitive drums, respectively, and are transferred to the transfer object or a recording paper to superimpose pixels, a color irregularity and/or color shift occurs on a color image if the superimposition of pixels (square of about 42 μm in length and breadth) is not carried out properly. This makes impossible the reproduction of a desired color. A shift in pixels is often caused by a temperature increase in the image forming apparatus, and the amount of the shift varies according to the type of equipment. Such a shift, therefore, must be corrected to same extent. Thus, a position shift in pixel superimposition is corrected by forming respective patterns colored in Y, M, C, and K on the transfer object, and reading the patterns with a transmittable or reflective optical sensor to detect the amount of shift of each color (e.g., see Japanese Laid-Open Patent Publication No. H10-333391).

In the image forming apparatus using the tandem method for image formation, each of the photosensitive drums for Y, M, C, and K is driven by a separate pulse motor (also called step motor). In this case, the pulse motor driving the photosensitive drum for K may be controlled independently while the other pulse motors driving the photosensitive drums for Y, M, and C are controlled in common. After a toner image formed on each photosensitive drum have been transferred to an intermediate transfer belt or directly to a recording paper, the photosensitive drum is cleaned in preparation for the formation of the next toner image. Upon cleaning the photosensitive drum, residual toner on the surface of the photosensitive drum is scraped off. This process applies heavy load to the pulse motor driving the photosensitive drum.

A pulse motor is an electric motor that operates in synchronization with an input pulse train, and is capable of exact positioning control in a simple circuit configuration, thus often used as a positioning means for a rotor. This pulse motor, however, loses control by getting out of synchronization, and occurs step out such as a halt when load on the motor is too heavy or the motor becomes incapable of catching up with incoming pulse train in synchronized move. The load on the pulse motor is likely to increase, particularly, when the photosensitive drum for K consuming a greater amount of toner is cleaned. This case leads to printing of a defective image due to a position shift of an image, which requires the suspension of printing by quickly detecting an abnormality. To quickly detect a rotation failure (abnormal rotation) of the photosensitive drum, providing the pulse motor with a detecting means for detecting fault is effective. This approach, however, poses a problem of hampering the miniaturization of the image forming apparatus and increasing costs.

When an abnormal rotation of the photosensitive drum occurs during printing of such image data received through a communication line as fax data, a toner image to be formed on the transfer object becomes disordered one, which may result in the loss of the image data. An image received through fax transmission is usually deleted from a memory device once printing is over even if a fine image cannot be obtained because of a rotation failure of the photosensitive drum due to out-of-step operation of the pulse motor. This makes it impossible for a user to retry the image forming process all over again like reprinting or recopying image data, etc., at hand. This causes a problem that is difficult for the user to reacquire the image data except by asking a transmitting party to retransmits a fax image.

SUMMARY OF THE INVENTION

The object of the present invention is to provide an abnormality detecting method and an image processing method for an image processor that can easily detect an abnormal rotation of a photosensitive drum without having a special detecting means but using an existing sensor, and keeps image data until a normal toner image is transferred and fine printing is carried out.

An abnormality detecting method for an image processor according to the present invention forms a toner image corresponding to image data on a plurality of photosensitive drums and transfers the toner image to a transfer object, wherein a rotation failure of the photosensitive drum is detected by detecting a position of the toner image on the transfer object at a given part to which the toner image formed on the photosensitive drum is transferred.

A rotation failure of the photosensitive drum is caused by out-of-step operation of the pulse motor driving the photosensitive drum. Detection of the position of the toner image is carried out by detecting the toner image on the upstream end or downstream end of a print page, using a sensor for detecting toner concentration or a sensor for detecting toner image position shift. A photosensitive drum whose abnormality is detected is displayed in a discriminated form.

When a rotation failure of the photosensitive drum is detected by the above method, the input image data is not deleted but is kept even after the end of image formation. The input image data in this case is supposed to be data received through fax communication.

PREFERRED EMBODIMENTS OF THE INVENTION

Figure 1:
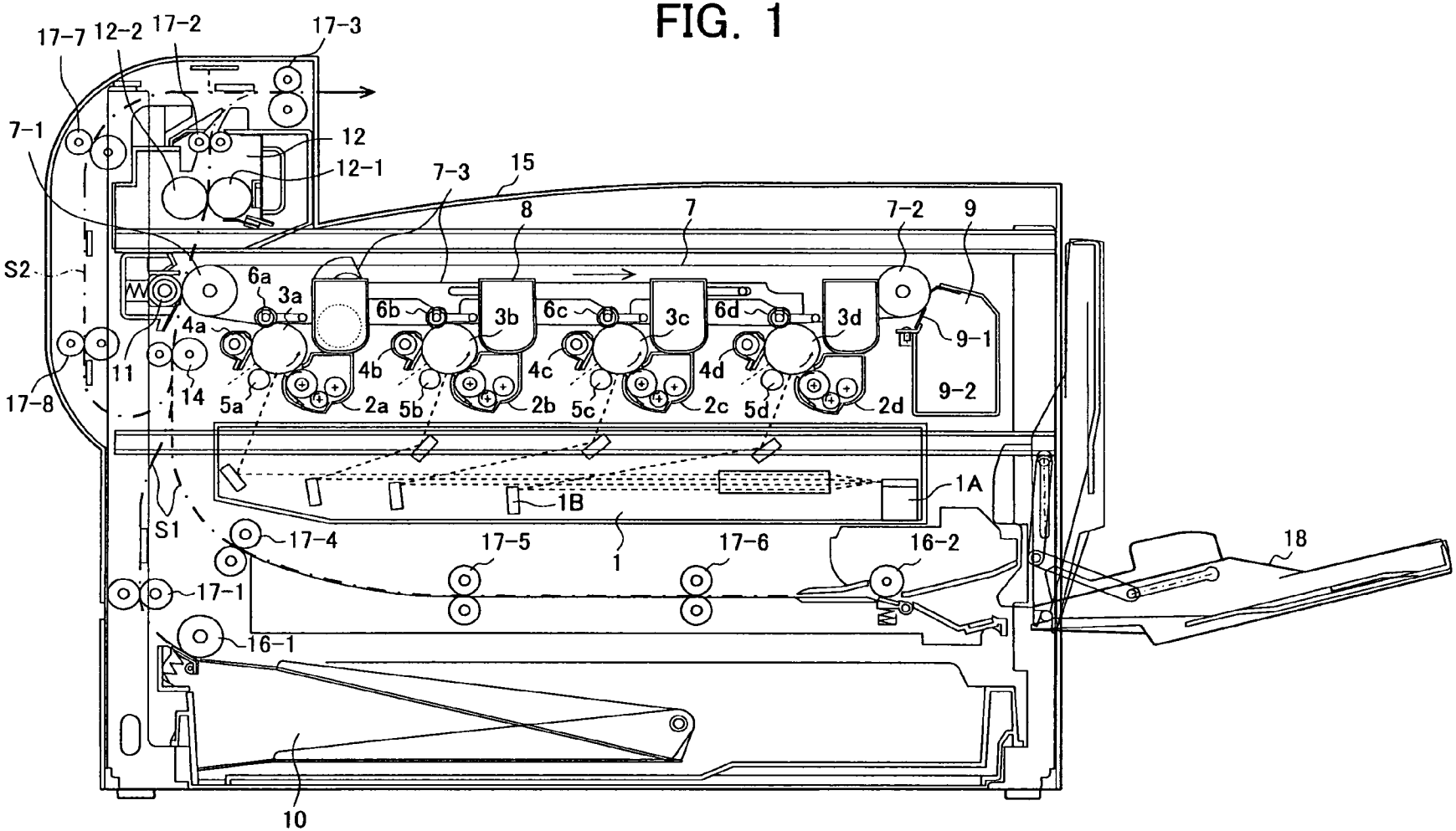
FIG. 1 depicts an example of an image forming apparatus to which the present invention applies.

An embodiment of the present invention is now described with reference to the drawings. FIG. 1 depicts an example of an image forming apparatus to which the present invention applies, and the outline of the image forming apparatus is described.

The image forming apparatus forms a multicolor (full color) image or a monochrome image on a prescribed sheet (recording paper) in accordance with image data transmitted from an external device (e.g., a terminal device such as personal computer). As shown in FIG. 1, the image forming apparatus includes an exposure unit 1, developing devices 2 (2*a* to 2*d*), photosensitive drums 3 (3*a* to 3*d*) serving as image carriers, cleaner units 4 (4*a* to 4*d*), electrifiers 5 (5*a* to 5*d*), an intermediate transfer belt unit 8, a fixing device 12, a paper conveyance path S1, a paper feeding cassette 10, and a paper ejecting tray 15.

Image data handled by the image forming apparatus corresponds to a color image using colors of black (K), cyan (C), magenta (M), and yellow (Y). The image forming apparatus, therefore, has respective four units of developing devices 2 (2*a* to 2*d*), of photosensitive drums 3 (3*a* to 3*d*), of electrifiers 5 (5*a* to 5*d*), and of cleaner units 4 (4*a* to 4*d*) to form four kinds of images corresponding to the four colors. In FIG. 1, the affixed reference numeral a corresponds to black, b corresponds to cyan, c corresponds to magenta, and d corresponds to yellow, thus four image stations (image forming units) are configured in the image forming apparatus.

The photosensitive drum 3 is disposed on the upper part of the image forming apparatus, where the photosensitive drum 3 is exposed to laser light emitted from the exposure unit 1 to form an electrostatic latent image corresponding to image data. The photosensitive drum 3 is made by coating the surface of a cylindrical aluminum alloy with a photosensitive material in a layer (not shown), and is so supported that a driving means (not shown), such as a pulse motor, can control the rotation of the photosensitive drum 3.

The electrifier 5 is an electrifying means that uniformly electrifies the surface (photosensitive material layer) of the photosensitive drum 3 with a given potential. The electrifier 5 is provided as a contact type roller-shaped or brush-shaped electrifier, as shown in FIG. 1, or may be provided as a charger type electrifier.

The exposure unit 1 is composed of a laser scanning unit (LSU) having a laser emitter 1A and a reflective mirror 1B. The laser emitter 1A emits laser light hued in each color based on received image data. The laser emitter 1A may be replaced with an array of light-emitting elements, such as a writing head composed of EL or LED. The exposure unit 1 has a function of exposing the electrified photosensitive drum 3 to laser light according to input image data to form an electrostatic latent image corresponding to the image data on the surface of the photosensitive drum 3.

The developing unit 2 develops an electrostatic latent image formed on each photosensitive drum 3 into an apparent image, using toner (developer) of each color (K, C, M, and Y) The developing unit 2 causes the electrostatic latent image formed on the surface of photosensitive drum 3 to absorb the toner.

The cleaner unit 4 removes and recovers toner remaining on the surface of the photosensitive drum 3 after image development and transfer, in preparation for the next image formation. Usually, the photosensitive material is electrically neutralized following toner image transfer to facilitate the removal of toner remaining on the surface of the photosensitive drum 3, and then the residual toner is removed physically by scraping it off, using a brush, etc.

The intermediate transfer belt unit 8, which is disposed above the photosensitive drums 3, includes an intermediate transfer belt 7, an intermediate transfer belt driving roller 7-1, an intermediate transfer belt tension mechanism 7-3, an intermediate transfer belt driven roller 7-2, intermediate transfer rollers 6 (6*a* to 6*d*) serving as primary transfer rollers, and an intermediate transfer belt cleaning unit 9. The intermediate transfer belt driving roller 7-1, the intermediate transfer belt tension mechanism 7-3, the intermediate transfer rollers 6, and the intermediate transfer belt driven roller 7-2 cause the intermediate transfer belt 7 to run in an arrowed direction with rotating drive of the intermediate transfer belt driving roller 7-1 after the intermediate transfer belt 7 is set.

The intermediate transfer rollers 6 are supported rotatably on a roller mounting portion of the intermediate transfer belt tension mechanism 7-3. As a result, these intermediate transfer rollers 6 (6*a* to 6*d*) are disposed rotatably on the inside of the intermediate transfer belt 7, which faces to each of the photosensitive drums 3 (3*a* to 3*d*), respectively. The intermediate transfer rollers 6 are supplied with a transfer bias for transferring toner images on the photosensitive drums 3 to the intermediate transfer belt 7.

The intermediate transfer belt 7 is so arranged as to be able to come in contact with respective photosensitive drums 3. Toner images of respective colors formed on the photosensitive drums 3 are sequentially superimposed and transferred to the intermediate transfer belt 7 to form a color toner image (multicolor toner synthetic image) on the intermediate transfer belt 7. The intermediate transfer belt 7 is formed into an endless belt using a film of about 100 μm to 150 μm in thickness.

Transfer of a toner image from the photosensitive drum 3 to the intermediate transfer belt 7 is carried out by the intermediate transfer roller 6 in contact with the back (inside) of the intermediate transfer belt 7. A high-voltage transfer bias for toner image transfer (positive high voltage that is reverse in polarity to negatively charged toner) is applied to the intermediate transfer roller 6. The intermediate transfer roller 6 is a roller that has a base material of a metal (e.g., stainless steel) shaft having a diameter of 8 mm to 10 mm, which metal shaft is coated with a conductive elastic material (e.g., ethylene-propylene rubber, urethane foam, etc.). This conductive elastic material allows uniform application of the high voltage to the intermediate transfer belt 7. While roller-shaped transfer electrodes are employed in the present embodiment, brushes may also be used as the transfer electrodes.

As described above, toner images developed on the photosensitive drums 3*a* to 3*d* according to respective hues are stacked on the intermediate transfer belt 7 to constitute image data (multicolor toner synthetic image) input into the image forming apparatus. The stacked image data is transferred onto a recording paper by a transfer roller 11, depending on the running of the intermediate transfer belt 7, the transfer roller 11 composing a transfer unit located at the point of contact between the recording paper conveyed on the paper conveyance path S1, which will be described later, and the intermediate transfer belt 7.

At this time, the intermediate transfer belt 7 and the recording paper are put under pressure to contact with each other by a given cramping force from the transfer roller 11 and a voltage for transferring toner to the recording paper is applied to the transfer roller 11. To constantly provide the transfer roller 11 with the above cramping force, either the transfer roller 11 or the intermediate transfer belt driving roller 7-1 is made of a hard material (metal, etc.) and the other is provided as an elastic roller, etc., made of a soft material (elastic rubber roller, expandable resin roller, etc.).

As described above, some toner sticks to the intermediate transfer belt 7 due to the contact with the photosensitive drum 3, or remains on the intermediate transfer belt 7 when the transfer roller 11 fails to transfer the toner to the recording paper. Such toner becomes the cause of a toner color mixture at the next process, and is, therefore, removed and recovered by the intermediate transfer belt cleaning unit 9. The intermediate transfer belt cleaning unit 9 has a cleaning blade 9-1 serving as a cleaning member in contact with the intermediate transfer belt 7, which cleaning blade 9-1 is supported by the intermediate transfer belt driven roller 7-2 from the back of intermediate transfer belt 7 with which cleaning blade 9-1 is in contact. Residual toner recovered by the cleaning blade 9-1 is dropped into a storage unit 9-2 placed below the cleaning blade 9-1 to be accumulated in the storage unit 9-2.

The paper feeding cassette 10 is the cassette that stores recording papers used for image formation. The paper feeding cassette 10 is disposed, for example, on the bottom of the image forming apparatus, that is, under the exposure unit 1. The paper ejecting tray 15, which is disposed on the top of the image forming apparatus, is the tray on which the printed recording papers are placed facedown.

The image forming apparatus has the paper conveyance path S1 through which a recording paper from the paper feeding cassette 10 is sent to the paper ejecting tray 15 via the transfer roller 11 and the fixing device 12. The paper conveyance path S1 extends substantially in the vertical direction from a paper feeding unit of the paper feeding cassette 10 toward the paper ejecting tray 15. The paper conveyance path S1 extending from the paper feeding cassette 10 to the paper ejecting tray 15 is provided with a pickup roller 16 (16-1), resist rollers 14, the transfer roller 11, the fixing device 12, conveyance rollers 17 (17-1, 17-2, and 17-3) conveying the recording paper, etc.

The conveyance roller 17 is a small roller that facilitates and assists with the conveyance of the recording paper, and a plurality of conveyance rollers 17 are arranged along the paper conveyance path S1. The pickup roller 16 is disposed on an end of the paper feeding cassette 10, working as a take-in roller that feeds recording papers one by one into the paper conveyance path S1.

The resist rollers 14 temporarily hold a recording paper conveyed on the paper conveyance path S1. The resist rollers 14 have a function of conveying the recording paper to the transfer unit (cramping unit between the transfer roller 11 and the intermediate transfer belt driving roller 7-1) in the timing so adjusted that the front end of a toner image on the intermediate transfer belt 7 is located at a given position from the front end of the recording paper.

The fixing device 12 includes a heat roller 12-1 and a pressure roller 12-2, which rotate over a recording paper held between the rollers 12-1 and 12-2. The heat roller 12-1 is adapted to have a prescribed fixing temperature that is set by a controlling unit on the basis of a signal from a temperature detector, which is not shown. The heat roller 12-1 has a function to melt, mix and press a transferred multicolor toner image on the recording paper and thermally fix the multicolor toner image on the recording paper by thermally pressing the recording paper working with the pressure roller 12-2.

The recording paper on which the multicolor toner image is fixed is ejected on the paper ejecting tray 15 with the multicolor toner image directed downward by means of the conveyance rollers 17-2 and 17-3.

Next, the conveyance path for the recording paper is described. The image forming apparatus is provided with the paper feeding cassette 10 that stores recording papers in advance, and also with a manual insertion tray 18 that spares a user the trouble of opening/closing the paper feeding cassette 10 when the user makes a few prints. Recording papers from the paper feeding cassette 10 and from the manual insertion tray 18 are guided one by one to the paper conveyance path S1 via respective pickup rollers 16 (16-1 and 16-2).

A recording paper to be conveyed from the paper feeding cassette 10 is picked up by the pickup roller 16-1, and is conveyed by the conveyance rollers 17-1 to the resist rollers 14. At this time, the recording paper is conveyed by the transfer roller 11 in the timing so adjusted that the front end of image data on the intermediate transfer belt 7 is located at a given position from the front end of the recording paper and the image data is transferred to (written onto) the recording paper. Subsequently, the recording paper is sent through the fixing device 12, where unfixed toner on the recording paper is melted and fixed with heat, and the recording paper is ejected onto the paper ejecting tray 15 from the paper ejecting roller 17-3 via the conveyance roller 17-2 (in a case of a single-side printing request).

Meanwhile, a recording paper to be conveyed from the manual insertion tray 18 is picked up by the pickup roller 16-2, and is conveyed through a plurality of conveyance rollers (17-6, 17-5, and 17-4) to the resist rollers 14. Subsequently, the recording paper further travels through the same conveyance path as the recording paper from the paper feeding cassette 10 travels, and is ejected onto the paper ejecting tray 15.

When duplex printing is requested, the paper ejecting roller 17-3 chucks the rear end of the above recording paper that has traveled through the fixing device 12 following the completion of single-side printing. The paper ejecting roller 17-3 then rotates in reverse to send the recording paper to a switchback conveyance path S2 provided with conveyance rollers (17-7 and 17-8) and the printing is executed on the reverse side of the recording paper via the resist rollers 14 and the paper is finally ejected onto the paper ejecting tray 15.

In actual image formation operation, to reduce wearing, deterioration, etc., of the photosensitive drum 3 due to contact of the photosensitive drum 3 with the intermediate transfer belt 7, the intermediate transfer roller 6 is moved away from the intermediate transfer belt 7 according to a printing request to allow contact and separation of the photosensitive drum 3 with and from the intermediate transfer belt 7 along with the movement.

A printing request includes a color mode request and a monochrome mode request. When the color mode request is made, the intermediate transfer rollers 6 (6*a* to 6*d*) move to come in contact with the reverse side of the intermediate transfer belt 7, that brings the surface of the intermediate transfer belt 7 into contact with the photosensitive drums 3 (3*a* to 3*d*) to create a state of readiness for primary transfer of toner images of respective hues to the intermediate transfer belt 7. When the monochrome mode request is made, only the intermediate transfer roller 6*a* for black image formation moves to come in contact with the reverse side of the intermediate transfer belt 7, that brings the surface of the intermediate transfer belt 7 into contact with the photosensitive drum 3*a* for black image formation to create a state of readiness for primary transfer of a black toner image to the intermediate transfer belt 7.

The description made with reference to FIG. 1 relates to an example that toner images formed on the photosensitive drums are primarily transferred to the intermediate transfer belt as a multicolor toner image, and then the images are secondarily transferred to a recording paper and fixed thereon. The toner images formed on the photosensitive drums, however, may be transferred directly to the recording paper to be fixed thereon. This method is, for example, disclosed in Japanese Laid-Open Patent Publication No. 2003-149952. According to the method, a recording paper is sucked onto a transfer/conveyance belt, and the photosensitive drums are brought into direct contact with the recording paper, then toner images on the photosensitive drums are superimposed and transferred to the recording paper to form image data composed of a multicolor toner synthetic image directly on the recording paper.

Figure 2A:
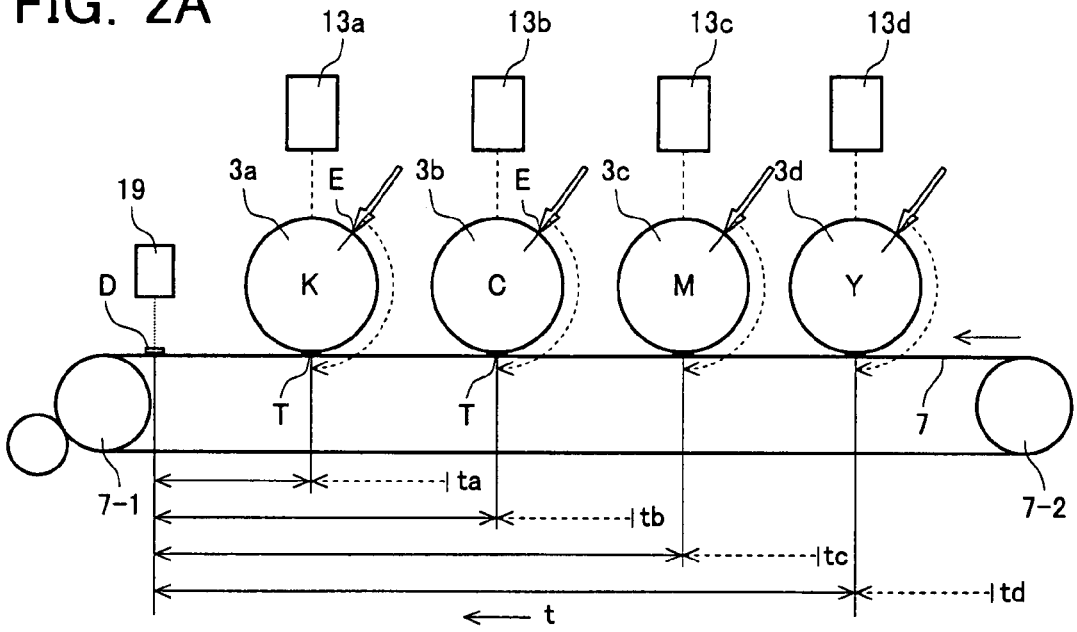
FIGS. 2A to 2C are explanatory views of the outline of detection of a rotation failure of a photosensitive drum according to the present invention.
Figure 2B:
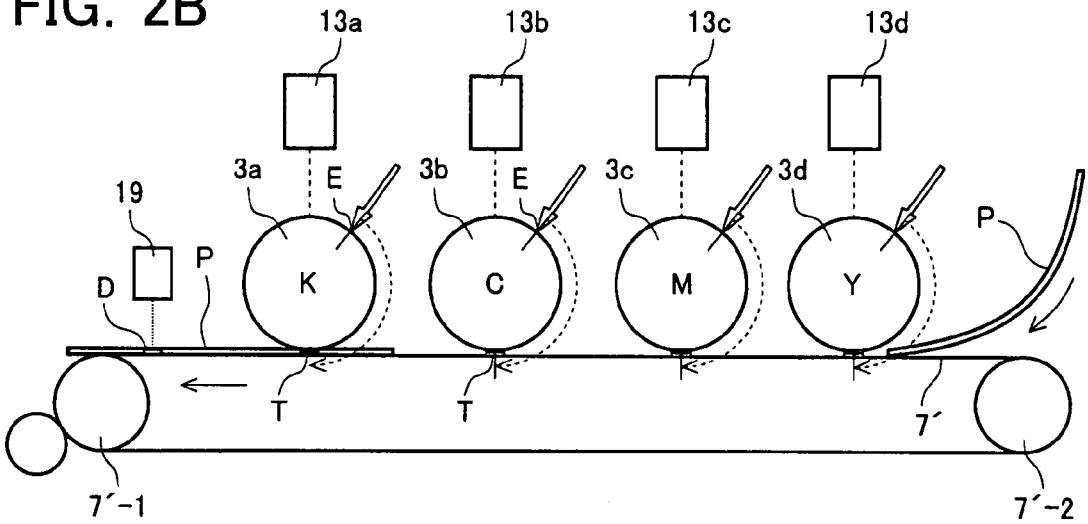
Figure 2C:
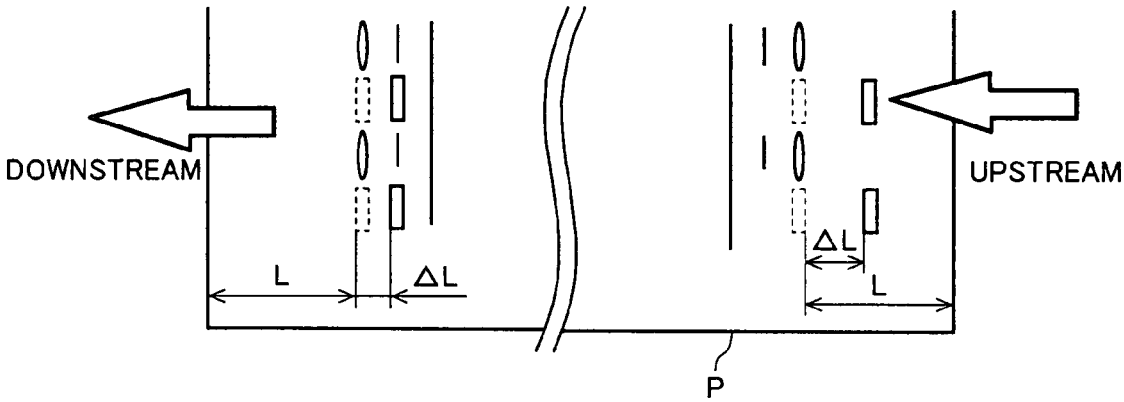

FIGS. 2A to 2C are explanatory views of the outline of detection of a rotation failure of the photosensitive drum according to the present invention. In FIGS. 2A to 2C, 13 (13*a* to 13*d*) denote pulse motors (also called step motors) that drive and control the photosensitive drums 3 (3*a* to 3*d*), 19 denotes a sensor that detects a toner image transferred to the intermediate transfer belt 7 or to a recording paper P. The sensor 19 is a photosensor capable of optically detecting an image. Usually, a photosensor detecting the concentration of a toner image or a position shift of a color image which are incorporated in the image forming apparatus, is used (serves also) as the sensor 19.

As shown in FIG. 2A, according to the present invention, the intermediate transfer belt 7 is moved in an arrowed direction by the driving roller 7-1 and the driven roller 7-2, and a toner image is transferred from the photosensitive drum 3 to a given part (position) of the intermediate transfer belt 7. The sensor 19 detects the presence of this toner image. The photosensitive drum 3 is exposed to light at an exposure point E to form an electrostatic latent image, which is supplied with toner to be developed into a toner image. The toner image is then transferred at the given part (position) of the intermediate transfer belt 7 at a transfer point T, and is detected at a measuring point D. In this image formation cycle, a time t to take to reach the measuring point D from the exposure point E for image exposure via the transfer point T is measured to detect whether the position of the image at the given part is normal or shifted.

Detection of the position of the image at the given part is carried out for the photosensitive drums 3*a* to 3*d* (colors K, C, Y, and M), and times (ta, tb, tc, and td) to take to reach the measuring point D from the exposure point E are detected, respectively. A detected time is compared with a preset time to find the presence/absence of a difference between the detected time and the preset time to detect the extent of position shift of the toner image. If the position of the toner image is normal, thus shows no position shift, the rotation of the photosensitive drum 3 is normal, which leads to a conclusion that the synchronized rotation of the pulse motor 13 driving the photosensitive drum 3 is normal. If a detected position shift of the toner image is, for example, several hundreds μm, the photosensitive drum 3 has trouble in rotation, which brings a conclusion that the pulse motor 13 is in a state of abnormality (out-of-step).

In detection of a position shift of a toner image, a color shift is detected to provide a proper color image. When a position shift is detected, timing for image reading, etc., is adjusted (resist adjustment). In this case, a shift of pixels of about 42 μm each is detected to find a position shift of the toner image, and this means detection of a color shift of several score μm. Based on a detection result, timing for image formation is corrected. The detection is carried out using a test patch image, etc., at the time of starting the image forming apparatus, restarting the image forming apparatus after a long period of service suspension, and inspecting equipment, etc.

In contrast, the method of abnormality detection according to the present invention allows detection of a position shift of an image that is actually under a printing process. The position shift detection, for example, is carried out regularly on a given print time basis or print page basis.

FIG. 2B depicts a process that the recording paper P is sucked and held onto a transfer/conveyance belt 7' and the sensor 19 detects whether a toner image transferred from the photosensitive drum 3 exists at a given part (position) on the recording paper P. In this case, in the same manner as in the case of FIG. 2A, the photosensitive drum 3 is exposed to light at the exposure point E to form an electrostatic latent image, which is supplied with toner to be developed into a toner image, then transferred at the given part (position) of the recording paper P conveyed on the conveyance belt 7', and detected at the measuring point D. In this image formation cycle, the time t to take to reach the measuring point D from the exposure point E for image exposure via the transfer point T is measured to detect whether the position of the image at the given part is normal or shifted. Subsequently, the synchronized rotation of the pulse motor 13 driving the photosensitive drum 3 is determined to be normal or abnormal.

FIG. 2C is an explanatory view of a given part for detection of a toner image. Generally, image data is printed on a recording paper on a print page basis, and the positions of the start end (downstream end in a printing direction) and of the termination end (upstream end in the printing direction) of an image to be printed on one page are predetermined in image data printing. The start end or termination end of the image is so determined that a distance L from the edge of the recording paper to the start end or termination end is several score mm, and an amount of shift (ΔL) from such position of the start end or of the termination end is detected to check the position of the toner image. The given part as described above, therefore, facilitates specifying and detecting the toner image. The upstream end, particularly, is easy to detect because an amount of position shift (ΔL) of the image to be detected often occurs on the edge side (blank side).

Figure 3:
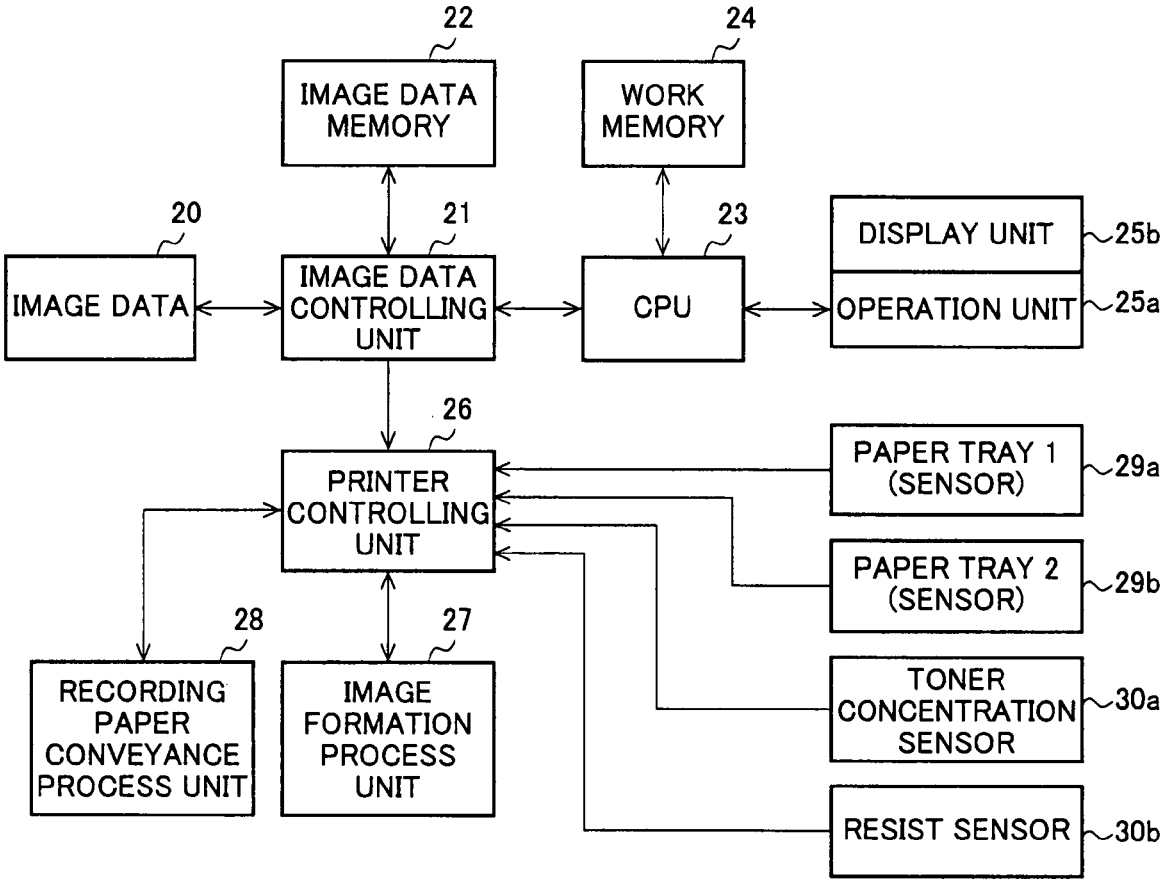
FIG. 3 is a block diagram of the outline of the image forming apparatus according to the present invention.

FIG. 3 is a block diagram of the outline of the above image forming apparatus according to the present invention. Image data 20 obtained through a scanner or a communication line is read by an image data controlling unit 21, and the read image data is stored temporarily in an image data memory 22. Preferably, a nonvolatile memory allowing data rewriting is used as the image data memory 22 so that the image data memory 22 keeps the image data until image printing has been properly finished. Work on image data acquirement and image editing is carried out under guidance of an operation unit 25*a* and a display unit 25*b*, and the data acquirement and editing is executed by a CPU 23 and a work memory 24.

The image data controlling unit 21 controls a printer controlling unit 26 to print the read image data on a recording paper. The printer controlling unit 26 takes a recording paper out of a paper tray 29*a* or 29*b* (or a manual insertion tray), and detects the edge of the paper with a sensor to select timing of transfer of the image data to the paper. A recording paper conveyance process unit 28 determines a conveyance path, conveyance timing, etc., for the recording paper taken out of the paper tray 29*a* or 29*b*. An image formation process unit 27 sets and selects the concentration, position, size, etc., of an image.

The image forming apparatus has a toner concentration sensor 30*a* that measures the concentration of transferred toner or a resist sensor 30*b* that detects a color irregularity or a color shift of a color image. Usually, a detection patch image is formed when the image forming apparatus is started or restarted after a long period of service suspension, and the sensors 30*a* and 30*b* detect a shift of the toner concentration or color of the patch image. A shift of toner concentration or color is corrected into a proper value to obtain a proper image. This detection by the sensors, however, is not carried out on a regular basis, but the sensors 30*a* and 30*b* are usually not used during operation of the image forming apparatus.

A rotation failure of the photosensitive drum during operation of the image forming apparatus may lead to the formation of a defective image or even to the formation of no image at all. In such a case, a user usually does not realize the occurrence of fault until looking at a printed out image. When image data under a printing process is the data transmitted through such a communication line such as fax line, reprinting the image data may be difficult. In such a case, the image forming apparatus must be stopped immediately to store the image data in the memory.

According to the present invention, a rotation failure of the photosensitive drum can be detected on a regular basis by using the toner concentration sensor 30*a* or the resist sensor 30*b*, which are not used regularly, according to the method described with reference to FIGS. 2A to 2C. This allows the reduction of production of defective copies to the minimum by immediately stopping the image forming apparatus once a fault occurs. The same effect can be achieved if the image forming apparatus is provided with a sensor means that constantly monitors the rotation state of the photosensitive drum. An additional sensor means, however, is not preferable because of the necessity of an extra space and the increase in cost.

Figure 4:
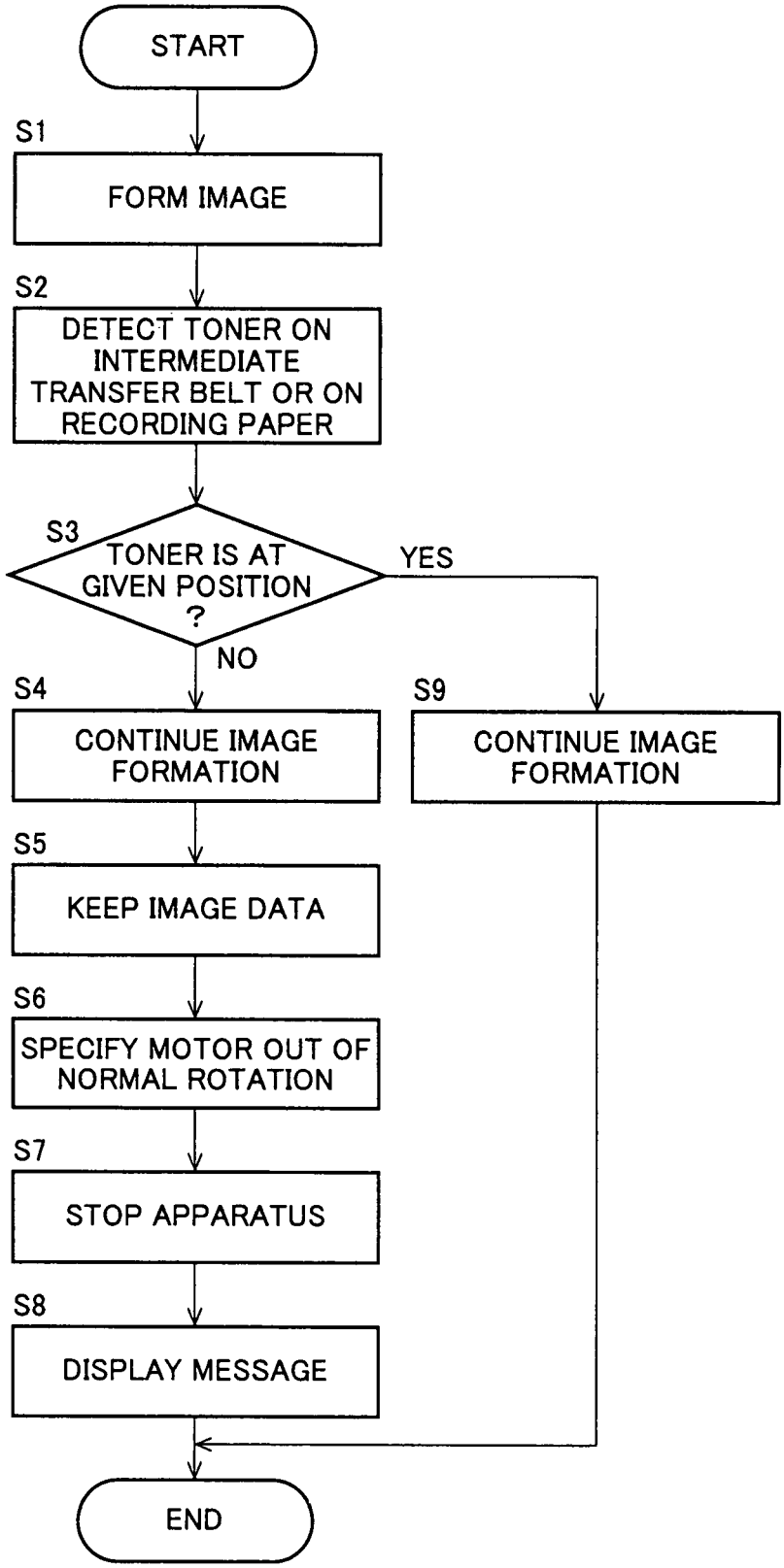
FIG. 4 is a flowchart for explaining an example of an image processing method using an abnormality detecting method of the present invention.

FIG. 4 is a flowchart for explaining an example of an image processing method using the above abnormality detecting method of the present invention. At step S1, image data is read in, and is subjected to a given image processing to form an image. According to the formed image, at step S2, an electrostatic latent image is formed on the photosensitive drum through an exposure process, and toner is stuck to the electrostatic latent image to form a toner image. The toner image is then transferred to a recording paper on the intermediate transfer belt or on the conveyance belt. The transferred toner image at a given part on the belt or paper is detected by a sensor.

Then, at step S3, it is detected whether the position of the detected toner image is normal or shifted. When the position of the toner image is normal (Yes), the rotation of the photosensitive drum is determined to be normal (synchronized operation of the pulse motor is normal). Subsequently, image formation is continued at step S9 to complete printing work. When the position of the toner image is shifted at step S3, image formation is continued at step S4 (image forming apparatus is not stopped immediately). Meanwhile, image data that follow the image data under a printing process is stored in the memory at step S5 and not deleted even after the end of printing.

At step S6, a pulse motor out of normal rotation is specified, and a printer is brought to a stop at step S7, then a state of rotation failure is displayed on the display unit at step S8. Preferably, the display unit displays a message of specifying the motor in fault, of indicating the cause of the fault, of a countermeasure to the fault, etc.

According to the above image processing method, even in the case of the image data such as fax data received through an external communication line, the image reproduction is possibly carried out by immediately detecting an image failure due to an abnormal rotation of the photosensitive drum and saving image data that follow the occurrence of the image failure. When image data not obtained through a communication line is printed, the image processing method can clarify the cause of a defective printed image when an image failure occurs due to an abnormal rotation of the photosensitive drum and stop continuing useless printing.

The present invention offers the following effect.

According to the present invention, a rotation failure of a photosensitive drum due to out-of-step operation, etc., of a pulse motor can be detected using an existing optical sensor, etc., so that an increase in space and costs due to the installation of a dedicated sensor means can be suppressed. When a rotation failure is detected, image data stored temporarily in a nonvolatile memory means, etc., is protected from deletion to prevent the loss of the image data.

The invention claimed is:

1. An abnormality detecting method for an image processor that forms, on a plurality of photosensitive drums, a toner image corresponding to input image data received to be printed and transfers the toner image to a transfer object, comprising:

detecting a position of the toner image on the transfer object at a given part to which the toner image formed on a photosensitive drum of the plurality of photosensitive drums is transferred; and determining a rotation failure of the photosensitive drum based on the detected position of the toner image, wherein when a rotation failure is determined, the input image data is held without deleting even after an end of image formation.

2. The abnormality detecting method for the image processor as defined in claim 1, wherein the rotation failure of the photosensitive drum is caused by out-of-step operation of a pulse motor driving the photosensitive drum.

3. The abnormality detecting method for the image processor as defined in claim 1, wherein a sensor for detecting toner concentration is used to detect the position of the toner image.

4. The abnormality detecting method for the image processor as defined in claim 1, wherein a sensor for detecting a toner image position shift is used to detect the position of the toner image.

5. The abnormality detecting method for the image processor as defined in claim 1, wherein a toner image on an upstream end of a print page is detected in abnormality detection.

6. The abnormality detecting method for the image processor as defined in claim 1, wherein a toner image on a downstream end of a print page is detected in abnormality detection.

7. The abnormality detecting method for the image processor as defined in claim 1, wherein a photosensitive drum whose abnormality is detected is displayed in a discriminated form.

8. The image processing method for the image processor as defined in claim 1, wherein the input image data is data received through fax communication.

9. The abnormality detecting method for the image processor as defined in claim 1, further comprising:

measuring an elapsed time from an exposure point at which the toner image is formed on the photosensitive drum to a measurement point at which the position of the toner image having been transferred from the photosensitive drum to the transfer object is detected; and comparing the elapsed time with a preset time to detect a position shift of the toner image.

10. The abnormality detecting method for the image processor as defined in claim 9, wherein a rotation failure of the photosensitive drum is determined according to an extent of the position shift of the toner image.

* * * * *